US011491530B2

(12) United States Patent
Tiraferri et al.

(10) Patent No.: US 11,491,530 B2
(45) Date of Patent: Nov. 8, 2022

(54) DEVICE FOR POSITIONING A BENDING TOOL

(71) Applicant: TRUMPF Maschinen Austria GmbH & Co. KG., Pasching (AT)

(72) Inventors: Matteo Tiraferri, San Gillio (IT); Andrea Tonda Roch, Turin (IT); Giovanni Vidotto, Chieri (IT)

(73) Assignee: TRUMPF MASCHINEN AUSTRIA GMBH & CO. KG, Pasching (AT)

( * ) Notice: Subject to any disclaimer, the term of this patent is extended or adjusted under 35 U.S.C. 154(b) by 875 days.

(21) Appl. No.: 16/342,631

(22) PCT Filed: Oct. 19, 2017

(86) PCT No.: PCT/AT2017/060278
§ 371 (c)(1),
(2) Date: Apr. 17, 2019

(87) PCT Pub. No.: WO2018/071946
PCT Pub. Date: Apr. 26, 2018

(65) Prior Publication Data

US 2019/0262889 A1 Aug. 29, 2019

(30) Foreign Application Priority Data

Oct. 20, 2016 (AT) ..... A 50960/2016

(51) Int. Cl.
*B21D 37/04* (2006.01)
*B21D 5/02* (2006.01)
(Continued)

(52) U.S. Cl.
CPC ..... *B21D 37/04* (2013.01); *B21D 5/0254* (2013.01); *B21D 37/147* (2013.01); *H01F 7/206* (2013.01); *H01F 2007/208* (2013.01)

(58) Field of Classification Search
CPC B23Q 3/15513; B23Q 3/1554; B23Q 3/1556; B23Q 3/15573; B21D 5/0209;
(Continued)

(56) References Cited

U.S. PATENT DOCUMENTS 4,530,028 A 7/1985 Metz et al.
5,595,560 A 1/1997 Kamada
(Continued)

FOREIGN PATENT DOCUMENTS

CN 206392636 U 8/2017
CN 206492804 U 9/2017
(Continued)

OTHER PUBLICATIONS

Felder, Translation of WO-2015176083-A1 (Year: 2015).*
(Continued)

*Primary Examiner* — Jessica Cahill
*Assistant Examiner* — Bobby Yeonjin Kim
(74) *Attorney, Agent, or Firm* — Collard & Roe, P.C.

(57) ABSTRACT

Device and method for positioning of a bending tool (1) by means of an electromagnet (2) that can be displaced along a magnetic guide,
which bending tool (1) is held on a tool holder (4) by a retaining carriage (3) that can be displaced in a direction of movement along a retaining-carriage guide and which bending tool (1) comprises a magnet holder (5) of a magnetizable material, wherein an adjustable magnetic force acts between the electromagnet and the magnet holder (5).

9 Claims, 3 Drawing Sheets

(51) Int. Cl.
*B21D 37/14* (2006.01)
*H01F 7/20* (2006.01)

(58) Field of Classification Search
CPC ..... B21D 5/0254; B21D 37/04; B21D 37/06; B21D 37/14; B21D 37/145; B21D 37/147; B21C 47/323
See application file for complete search history.

(56) References Cited

U.S. PATENT DOCUMENTS

| | | | |
|---|---|---|---|
| 6,188,151 | B1 | 2/2001 | Livshits et al. |
| 2008/0295566 | A1 | 12/2008 | Hansen |
| 2013/0027833 | A1 | 1/2013 | Rabe et al. |
| 2017/0144206 | A1 | 5/2017 | Felder |

FOREIGN PATENT DOCUMENTS

| | | | | |
|---|---|---|---|---|
| DE | 31 12 465 | A1 | 10/1982 | |
| DE | 32 12 465 | A1 | 10/1983 | |
| DE | 199 28 831 | A1 | 12/2000 | |
| DE | 10 2011 052 173 | B3 | 9/2012 | |
| EP | 1 479 461 | A1 | 11/2004 | |
| EP | 2 946 846 | A1 | 11/2015 | |
| FR | 2 791 590 | A1 | 10/2000 | |
| JP | S58-181593 | A | 10/1983 | |
| JP | S62-228432 | A | 10/1987 | |
| JP | H10-192988 | A | 7/1998 | |
| JP | 2003-117607 | A | 4/2003 | |
| JP | 2009-237193 | A | 10/2009 | |
| WO | 99/35656 | A2 | 7/1999 | |
| WO | 01/08174 | A1 | 2/2001 | |
| WO | WO-2015176083 | A1 * | 11/2015 | ..... B21D 37/04 |
| WO | 2016/109862 | A1 | 7/2016 | |

OTHER PUBLICATIONS

International Search Report in PCT/AT2017/060278, dated May 22, 2018.

International Search Report in PCT/AT2017/060277, dated Feb. 27, 2018.

Letter of Austrian Patent Attorney to European Patent Office in PCT/AT2017/060277, dated Jul. 31, 2018, with English translation of relevant parts.

* cited by examiner

| | Volt | Current strength | Resistance | Power | Duty factor | 11 ON-time |
|---|---|---|---|---|---|---|
| | [V] | [I] | [ohm] | [w] | % | sec |
| usable voltage range | 2 | 0,09 | 22 | 0,18 | 100 | No limit |
| | 4 | 0,18 | 22 | 0,73 | 100 | No limit |
| | 6 | 0,27 | 22 | 1,64 | 100 | No limit |
| | 8 | 0,36 | 22 | 2,91 | 100 | No limit |
| | 10 | 0,45 | 22 | 4,55 | 100 | No limit |
| | 12 | 0,54 | 22 | 6,50 | 100 | No limit |
| | 14 | 0,64 | 22 | 8,91 | 73 | 219 |
| | 16 | 0,73 | 22 | 11,64 | 56 | 168 |
| | 18 | 0,82 | 22 | 14,73 | 44 | 132 |
| | 20 | 0,91 | 22 | 18,18 | 36 | 107 |
| | 22 | 1,00 | 22 | 22,00 | 30 | 89 |
| | 24 | 1,09 | 22 | 26,18 | 25 | 74 |
| | 26 | 1,18 | 22 | 30,73 | 21 | 63 |
| | 28 | 1,27 | 22 | 35,64 | 18 | 55 |
| | 30 | 1,36 | 22 | 40,91 | 16 | 48 |
| | 32 | 1,45 | 22 | 46,55 | 14 | 42 |

DEVICE FOR POSITIONING A BENDING TOOL

CROSS REFERENCE TO RELATED APPLICATIONS

This application is the National Stage of PCT/AT2017/060278 filed on Oct. 19, 2017, which claims priority under 35 U.S.C. § 119 of Austrian Application No. A 50960/2016 filed on Oct. 20, 2016, the disclosure of which is incorporated by reference. The international application under PCT article 21(2) was not published in English.

This invention relates to a device and a method for positioning of a bending tool by means of an electromagnet that can be displaced along a magnetic guide, which bending tool is held on a tool holder by a retaining carriage that can be displaced along a retaining-carriage guide and which bending tool comprises a magnet holder of a magnetizable material, wherein a magnetic force acts between the electromagnet and the magnet holder.

Machine tools for bending of workpieces usually have a machine frame, on which bending tools are disposed that are able to apply a machining force on a workpiece for forming of the workpiece. In order to permit a force transmission matched to the workpiece, the machine tools usually have tool holders, on which tool holders specifically designed bending tools can be arranged. For implementation of the individual machining stages on the workpiece, it is necessary to exchange the tools or to change them with respect to their position. For this purpose, usually the tool holder that holds the bending tools is unlocked, so that the bending tools arranged therein can be manipulated. In a bending machine, for example, the tool holder is linearly designed and extends over the entire length of the pressing bar.

In the case of a manual reconfiguration of the tool, the bending tool must be grasped by the machine operator and taken out of the tool holder or pushed into the tool holder. This is easily possible in the case of small bending tools for the machining of light materials, such as thin metal sheets, for example, whereas, in the case of tools for the machining of heavy structural parts, this requires a considerable exertion of force or is no longer possible manually.

According to the prior art, systems and devices are known in which tools, which in the following will be understood as bending tools, are picked up by means of a gripper at one location of the machine, removed from that location and consequently transferred. However, this requires a manipulating robot, which performs manipulating actions in one region of the machine. In this case, case it should be ensured that no persons are jeopardized by the manipulating actions.

It is further known how to push a group of inserted tools by means of an ejector device from the tool holder onto a pick-up device disposed laterally in longitudinal extent of the pressing bar, after which this pick-up device is moved into a parked position or into a tool magazine.

However, such systems are usually characterized by a great complexity and usually require larger modifications or extensions of the machine.

Furthermore, according to the prior art, changing devices are known in which the bending tools being used are usually of metal and thus can be held by a magnet. For this purpose, a retaining carriage is brought up to the tool holder of the bending tool, in order to pick up the tool by means of a retaining magnet disposed in the retaining carriage and to pull the bending tool along the tool holder and to change the position of the tool. Upon reaching of an end position, the magnetic force of the magnet is deactivated, whereby the bending tool and the retaining carriage detach from one another. In this situation, however, it is disadvantageous that, as a consequence of the acting magnetic field, a residual magnetism is built up in a metallic object, especially in the bending tool and also in the changing carriage. This may cause the retaining magnet and the bending tool to cling persistently to one another or to be capable of being detached from one another only by further actions. Furthermore, metallic debris, such as can be produced during the machining of metallic workpieces, may accumulate on the tools and on the changing carriage.

Furthermore, the problem exists that the magnetized bending tools and/or bending tools having a residual magnetism as well as the magnetized retaining magnet and/or the retaining magnet having a residual magnetism attract a magnetizable workpiece to be machined, such as a light metal sheet, for example. Hereby the magnetizable workpiece may be picked up or at least the alignment of the workpiece may be changed in relation to the machine tool. This may cause a defective machining of the workpiece due to an incorrect positioning of the workpiece.

EP2946846 discloses a tool-changing device for a forming press having a tool magazine and a transfer device for transfer of the forming tools from the tool magazine to the forming press, wherein the one transfer device comprises a drivable push chain. The transfer device further comprises an electromagnet for pick-up of the forming tool.

DE3212465 discloses a transport device having at least one holding magnet, in which transport device sensor units in the form of induction coils are disposed between the limbs or around the limbs in a manner symmetric relative to the center of the holding magnet. With the assistance of this sensor means, it is possible to detect the direction of the approach of the holding magnet toward a workpiece and to use the magnetic-field change detectable by the sensor means for control purposes. DE3212465 discloses the demagnetization of the magnet and the adaptation of the signal strength of the magnet to the workpiece to be picked up.

U.S. Pat. No. 5,595,560 discloses a bending press together with a loading station. The read-out of codes is described, which codes are linked to data about the workpiece to be picked up.

The task of the invention now lies in providing a method that permits the exact and rapid positioning of magnetizable bending tools in a machine tool.

This task is accomplished by a method and a device according to the claims.

According to the invention, this is accomplished in that the electromagnet and the magnet holder have congruent polygonal shapes capable of being positioned one inside the other.

The magnetic forces acting between the electromagnet and of the magnet holder are defined by the field strength of the magnet and by the size of the contact faces of the electromagnet and the magnet holder, among other factors. Due to the structure of the surface of the electromagnet and of the surface of the magnetic holder as congruent polygonal shapes capable of being inserted one inside the other, the area of contact acting between electromagnet and magnet holder is increased. Consequently, the device according to the invention is characterized in that the magnetic force is increased or maximized purely by the shape of the electromagnet and of the magnet holder. This in turn has the effect that the magnetic field strength that can be generated by energization of the electromagnet by means of a voltage can be adjusted to a weaker value, albeit with maintenance of the necessary magnetic force, whereby the influence of the applied magnetism on the bending machine may in turn be reduced.

The electromagnet and the magnet holder may be constructed as a hollow member or as a member capable of being introduced into the hollow member. The electromagnet and the magnet holder may be, for example, a shell or a hemisphere, wherein the hemisphere can be positioned in the interior of the shell. Likewise a structure as a hollow cone or cone is conceivable, wherein the cone can be positioned in the interior of the hollow cone.

In the converse sense, the magnet holder may have a star-like shape and the electromagnet a shape congruent to the star-like shape of the magnet holder.

In the converse sense, the magnet holder may have a star-like shape and the electromagnet a shape congruent to the star-like shape of the magnet form.

The contact faces of the electromagnet and of the magnet holder may be spaced apart. In a semi-industrial system, which comprised an electromagnet having a star-like cross section and a magnet holder having a congruent negative shape, the inner contact area is 563.0 $mm^2$ and the outer contact area is 1223.0 $mm^2$ in size.

The electromagnet or the magnet holder may have a round shape in sub-regions. In this case, the magnet holder or the electromagnet has, in these sub-regions, an annular shape congruent to the round shape.

In a semi-industrial system, which comprises an electromagnet having an annular cross section and a magnet holder having a round cross section, the inner contact area was 653.0 $mm^2$ and the outer contact area was 700.0 $mm^2$ in size, wherein the contact faces were again spaced apart from one another.

The magnet holder may comprise one further electromagnet, which is able to magnetize the magnetizable material from which the magnet holder is formed.

The invention also relates to a method for positioning of a bending tool by means of an electromagnet, which bending tool is held on a tool holder by a retaining carriage that can be displaced along a retaining-carriage guide and which bending tool comprises a magnet holder of a magnetizable material, wherein the electromagnet can be displaced along a magnetic guide and the electromagnet and the magnet holder may have congruent shapes.

The method according to the invention, disclosed in the following, offers a solution to the technical task of keeping, as small as possible, the influence, on the bending machine and its components, of the electromagnets used for positioning of the bending tool along the retaining-carriage guide and of the magnetism generated by the electromagnets.

According to the invention, this is accomplished in that the electromagnet (2) is energized with a nominal voltage for generation of a nominal force as magnetic force, which nominal force, in dependence on

- the tool weight and/or
- the inertial forces acting on the bending tool (1) and/or
- the friction acting in the retaining-carriage guide and/or
- the size of the contact area of the contact faces (7) and/or
- the orientation of the magnetic force relative to the movement direction and/or
- an extension of the magnetic field into regions having further magnetizable workpieces is increased or decreased by a pulse width modulation or by a change of a voltage or by a change of the current capacity in time spans for generation of the magnetic force.

The technical solution disclosed within the scope of this invention provides that the magnetic force acting between the electromagnet and the magnet holder is adjusted in dependence on the above-mentioned influencing factors. This adaptation is further marked by the guiding principle of keeping the magnetic force or the nominal force so small that the nominal force as a magnetic force and the associated magnetic field cause no disturbances if at all possible.

The magnetic force acting between the electromagnet and the magnet holder may be a force of attraction or a force of repulsion.

In the case of action of the magnetic force as a force of repulsion, the bending tool is pushed by the displaceable electromagnet, wherein the magnet holder is always spaced apart in dependence on the magnitude of the magnetic force. Prior to attainment of the desired position of the bending tool in the bending machine, the pushing of the bending tool by the electromagnet must be adjusted such that the bending tool is able to come to a stop. If necessary, the bending tool must be braked.

In the case of action of the magnetic force as a force of attraction between the electromagnet and the magnet holder, the bending tool is coupled with the electromagnet.

For attainment of the nominal force, the first electromagnet, or more precisely the coil of the first electromagnet, is energized with the nominal voltage. In the case of a 12-V electromagnet, for example, the nominal voltage is 12 V.

The necessary magnetic force is dictated by, among other factors, the dead weight of the bending tool. In a test system, these dead weights vary between several hundred grams and 25 kilograms. A dead weight of a tool is measurable or can be regarded by the person skilled in the art as known or as determinable.

During the positioning in the bending machine, the bending tool is accelerated positively and negatively, wherein the bending tool may be pulled or pushed by the moving electromagnet. In order to suppress loosening or in general decoupling of the bending tool, especially of the magnet holder from the electromagnet, the inertial forces are to be taken into consideration, especially for heavy bending tools. This also includes being able temporarily to increase or decrease the nominal voltage for generation of the necessary magnetic force during the (negative or positive) acceleration of the bending tool.

The frictional force acting between the tool holder and the retaining carriage may act counter to the inertial force acting on the bending machine or may act in a substantially equal direction as that inertial force. The person skilled in the art is able to determine the frictional force substantially from the dead weight of the bending tool and a coefficient of friction to be applied. If necessary, a distinction must be made between a static friction and a sliding friction.

The direction of movement of the retaining carriage and consequently of the bending tool is predetermined by the retaining-carriage guide. In no case does the movement of the bending tool that takes place during the positioning of the bending tool always have to be linear; the bending tool may also be brought into the desired position in a curved movement.

The movement of bending tool and electromagnet along a polygonal movement track has a relative displacement of electromagnet and magnet holder as a consequence, whereby a change of the orientation of the magnetic force in relation to the movement direction also occurs. This may necessitate having to increase the magnetic force.

The influencing factors mentioned above can be represented as vector variables. The person skilled in the art obtains the necessary magnetic force by summation of these vector variables with fulfillment of an equilibrium condition by application of common science. If necessary, the person skilled in the art multiplies the summation of the vector variables with a factor of safety.

In summary, it follows that the sum of the forces acting on the contact faces must be smaller than or equal to the magnetic force.

A pick-up of the tool on the retaining carriage by means of the retaining magnets has the advantage that no pick-up takes place via a mechanical coupling. A tool holder that is attracted by the retaining magnets according to the method according to the invention does not have to be remachined even after multiple use.

Furthermore, the extension of the magnetic field of the electromagnet into regions having further magnetizable workpieces, such as, for example, the workpiece to be machined with the assistance of the bending tool, is taken into consideration. If the electromagnet is sufficiently far removed from the further workpieces, so that the magnetic field created by the electromagnet does not extend into regions of further workpieces, a reduction of the nominal force to the necessary minimum magnetic force may no longer be needed.

The person skilled in the art is able, by application of common science, to calculate a sufficiently large distance of the magnetic field or a sufficiently small field strength of the magnetic field for an attraction of a further magnetizable workpiece, since restraining forces have to be overcome for attraction of a further magnetizable workpiece. These restraining forces may be the dead weights of the further magnetizable workpieces.

The person skilled in the art may use statistical values to define a maximum expected dead weight of a further magnetizable workpiece.

The method according to the invention may comprise routines, by means of which a driving force is measured that is necessary for movement of the retaining carriage, if necessary together with the tool. A change of the driving force or of the necessary driving power or of the traction force may be a sign that a further magnetizable workpiece has been picked up by the electromagnet. Furthermore, a deviation of the driving force and/or of the driving power from reference values may provide such an indication.

The method according to the invention may comprise further routines for continuous measurement of the forces acting on electromagnets. A sudden increase of the forces acting on the electromagnet, especially the weight forces, may be an indication that a further magnetizable workpiece has been attracted by the magnet.

For simpler measurement of a change of the driving force and/or of the necessary driving power, sub-stretches of the stretch along which the retaining carriage is movable by means of the guide may be defined, in which sub-stretches external influences such as, for example, a soiling, are suppressed by suitable measures according to the prior art.

The method according to the invention may be characterized in that the nominal force is increased or decreased in levels.

In a semi-industrial system, seven levels 1 to 7 are provided, wherein level 4 relates to the case that the magnetic force corresponds to the nominal force. Levels 1 to 3 relate to a decreased nominal force and levels 5 to 7 to an increased nominal force.

The introduction of levels may have the advantage that groups of tools are allocated to a certain level.

The method according to the invention may further comprise that the tool weight and/or the eccentricity are measured by means of measuring devices and/or are retrieved from a database, and the magnetic force is adjusted in dependence on the eccentricity.

A center of gravity of the bending tool that is eccentric relative to the retaining-carriage guide influences the forces acting in the holding-carriage guide and thereby the friction acting in the retaining-carriage guide.

The method according to the invention may be characterized in that the nominal force is increased or decreased in dependence on the position of the retaining carriage and/or of the passage of time.

For example, if the electromagnet is traveling through a region adjacent to further magnetizable workpieces, the magnetic force may be reduced, for example at a constant speed, since on the one hand no inertial forces develop as a consequence of an acceleration and on the other hand an attraction of the further workpieces may be avoided hereby in the case that the magnetic field extends to the further workpieces.

Within the scope of the method according to the invention, the bending tool may be demagnetized at least partly.

Due to the demagnetization of the bending tool it is prevented that a residual magnetization remaining in the bending tool picks up further magnetizable workpieces or the position of the workpiece to be machined with the tool is changed by the residual magnetic field.

The tool may be partly demagnetized in dependence on the temporary position of the retaining carriage or of the tool.

The invention disclosed here is in no case restricted to the demagnetization of the bending tool in the stationary condition and/or in a position such as the residence of the bending tool in a tool store or in a position introduced into the bending machine. The demagnetization may already be begun before the arrival of the tool being moved into the positions, in order to avoid idle times of a bending machine. The demagnetization during the positioning of the bending tool always has to take place with maintenance of the necessary magnetic force.

The bending tool may be demagnetized at least partly before and/or during and/or after the positioning of the bending tool.

The demagnetization parameters may be adjusted in dependence on the movement of the bending tool and/or of the speed of movement of the tool.

The demagnetization parameters may be loaded from a database.

The invention will be described in more detail on the basis of the following figures and of the following description of the figures, wherein the figures and the description of the figures relate merely to possible embodiments, which in no case restrict the protective subject matter defined by the claims. The person skilled in the art is capable of combining the figures and the relevant parts of the description of the figures with the general text of the description presented above.

In the figures, the following elements are denoted by the reference symbols preceding them:

1 Bending tool
2 Electromagnet
3 Retaining carriage
4 Tool holder
5 Magnet holder
6 Bending form
7 Contact face

8 Magnetic guide
9 Movement direction
10 Retaining-carriage guide
11 Column for ON-time
12 Working cycle
13 First time span
14 Second time span FIG. 1 shows a side view of electromagnet and bending tool.

Figures 5, 6:
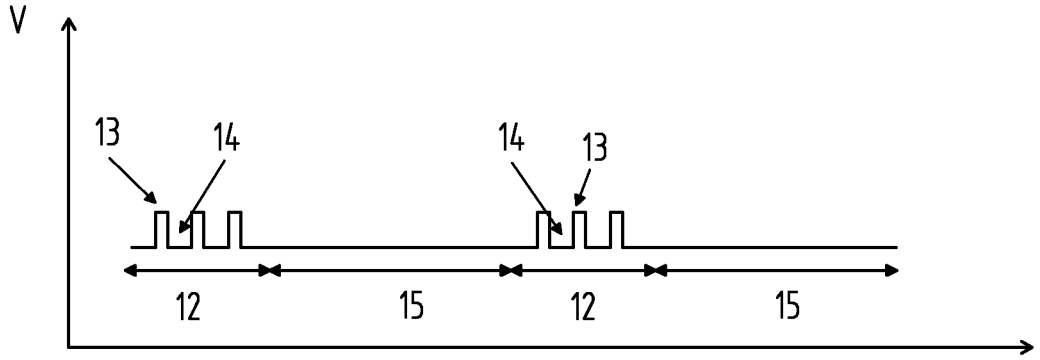

FIG. 5 comprises a table.

FIG. 6 illustrates a periodic loading of the electromagnet for suppression of an overheating.

Figure 1:
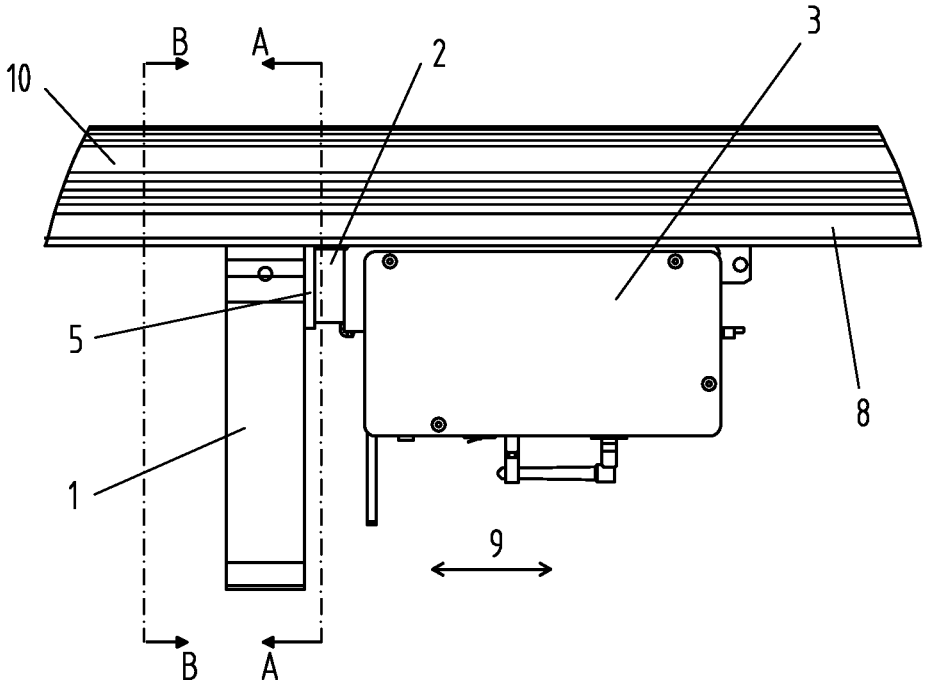
Figure 2:
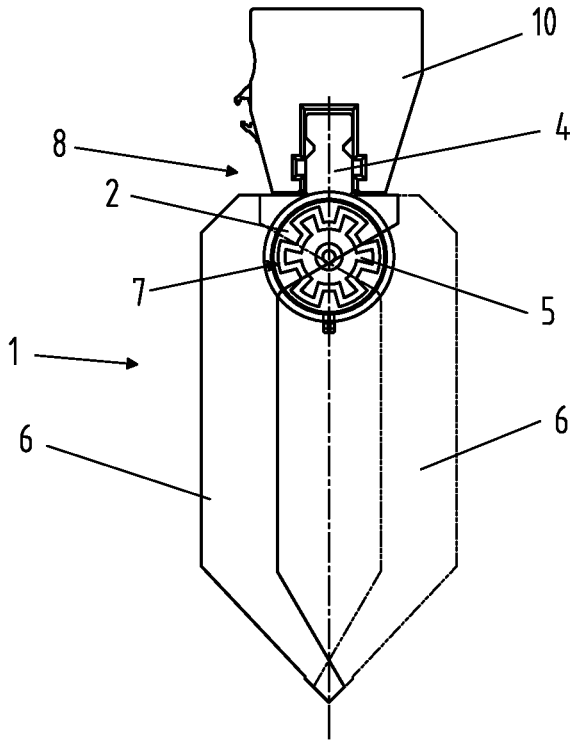
FIG. 2 and FIG. 3 show sectional views of the electromagnet and of the bending tool.
Figure 3:
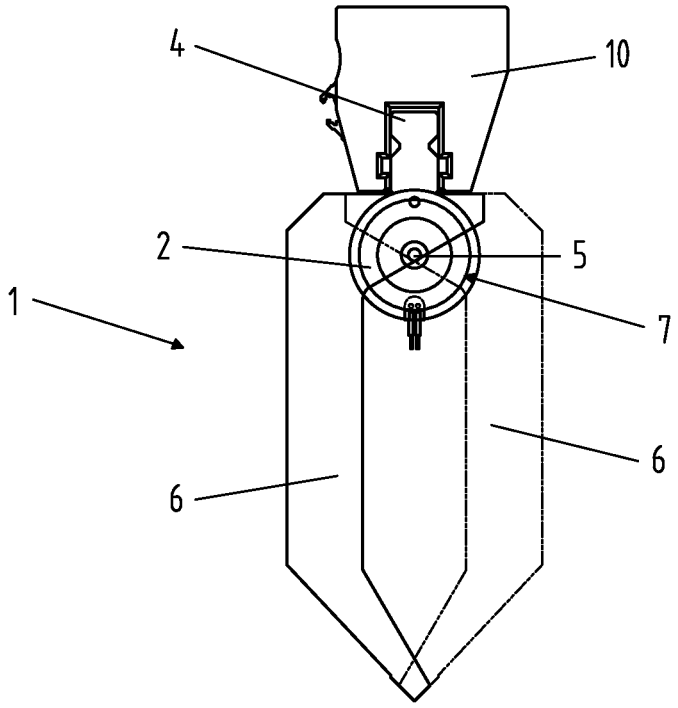

FIG. 1 shows a side view of the device according to the invention, wherein the position of the sectional views shown in FIG. 2 and FIG. 3 is indicated by the line A-A in FIG. 1. Furthermore, line B-B shows the position of the sectional view shown in FIG. 4.

FIG. 1 shows an embodiment of the device according to the invention for positioning of the bending tool 1 by means of an electromagnet 2 that can be displaced along a magnetic guide 8. The bending tool 1 comprises a tool holder 4, not visible in FIG. 1, via which tool holder 4 the bending tool 1 is retained by a retaining-carriage guide 10, visible in FIG. 1, via a detachable mechanical connection. A retaining carriage 3 is mounted displaceably in a direction of movement 9 along the a retaining-carriage guide 10.

In the embodiment illustrated in FIG. 1, the retaining-carriage guide 10 and the magnetic guide 8 are formed in one piece. The electromagnet 2 and the retaining carriage 3 are consequently displaceable in parallel directions of movement 9.

The bending tool 1 comprises a magnet holder 5 of a magnetizable material, wherein a magnetic force acts between the electromagnet 2 and the magnet holder 5 upon energization of the electromagnet with a voltage.

FIG. 2 shows a sectional view of the electromagnet 2 and of the bending tool 1 as parts of an embodiment of the device according to the invention for positioning of a bending tool 1 in a bending machine, not illustrated in FIG. 2.

The bending tool 1 comprises bending forms 6, which, for forming of a workpiece, not illustrated in FIG. 2, are pressed onto this workpiece. The bending forms 6 determine the shape of the bent workpiece, among other effects.

The bending tool 1 is retained on a retaining-carriage guide 10 via the tool holder 4. The retention of the bending tool 1 takes place via a detachable mechanical connection, wherein the type of construction of this mechanical connection has no influence on the device according to the invention.

A retaining carriage 3 is mounted displaceably in a manner normal to the plane of the diagram along the retaining-carriage guide 10, illustrated in FIG. 2.

The positioning of the bending tool 1 in a direction normal to the plane of the diagram of FIG. 2 takes place by a displacement of the electromagnet 2 in a direction normal to the plane of the diagram of FIG. 2, wherein a magnetic force is established between the electromagnet 2 and the magnet holder 5. For this purpose, the magnet holder 5 is made of a magnetizable material.

The electromagnet 2 is designed as a hollow member, wherein the magnet holder 5 is introduced into the inner region of the hollow member. The electromagnet 2 and the magnet holder 5 have—as is visible in the sectional diagram of FIG. 2—congruent polygonal shapes.

In particular, the magnet holder 5 has a star-like cross-sectional shape. The electromagnet 2 has, in cross section, a negative shape congruent to this.

A contact face 7 of the electromagnet 2 and a contact face of the magnet holder 5 are spaced apart from one another. Accordingly, these contact faces are of different sizes.

The shaping, according to the invention, of electromagnet 2 and magnet holder 5 may permit the magnetic field generated by the electromagnet 2 to be adjusted to such a weak value that it does not extend into sub-regions of the tool holder 4. The magnetic field may be limited substantially to sub-regions of the bending forms 6 directly adjacent to the electromagnet 2.

FIG. 3 shows a side view of the electromagnet 2 and of the bending tool 1 as parts of a further embodiment of the device according to the invention for positioning of a bending tool 1 in a bending machine, not illustrated in FIG. 3.

The bending tool 1 comprises bending forms 6, which, for forming of a workpiece, not illustrated in FIG. 3, are pressed onto this workpiece. The bending forms 6 determine the shape of the bent workpiece, among other effects.

The bending tool 1 is retained on a tool holder 4 on a retaining-carriage guide 10. The retention of the bending tool 1 takes place via a detachable mechanical connection, wherein the type of construction of this mechanical connection has no influence on the device according to the invention.

A retaining carriage, not illustrated in FIG. 3, is mounted displaceably in a manner normal to the plane of the diagram along a retaining-carriage guide 10.

The positioning of the bending tool 1 in a direction normal to the plane of the diagram of FIG. 3 takes place by a displacement of the electromagnet 2 in a direction normal to the plane of the diagram of FIG. 3, wherein a magnetic force is established between the electromagnet 2 and the magnet holder 5. For this purpose, the magnet holder 5 is made of a magnetizable material.

The electromagnet 2 is designed as a round hollow member, wherein the magnet holder 5 is introduced into the inner region of the hollow member. The electromagnet 2 and the magnet holder 5 have—as is visible in the sectional diagram of FIG. 2—congruent polygonal shapes.

In particular, the magnet holder 5 has a circular cross-sectional shape. The electromagnet 2 has an annular cross-section shape as a congruent shape.

Figure 4:
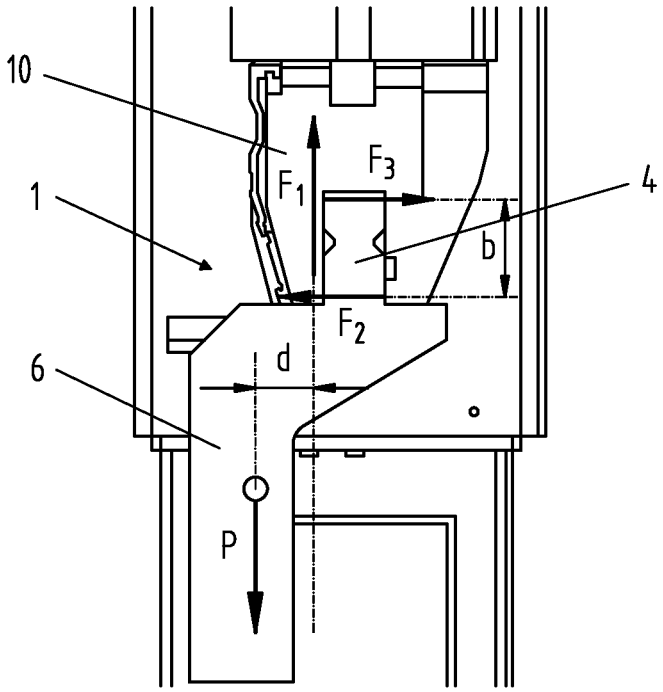
FIG. 4 shows a sectional view of the bending tool and of the retaining carriage.

FIG. 4 shows the sectional view B-B indicated in FIG. 1, wherein a bending tool 1 different from the bending tools illustrated in FIG. 2 and FIG. 3 is illustrated in FIG. 4. Bending tool 1, comprising a bending form 6, has a shape having a center of gravity P eccentric relative to the retaining-carriage guide 10. Because of the eccentric position of the center of gravity P, at which center of gravity P the dead weight of the bending tool 1 acts, the forces F1, F2 and F3 are developed, which forces F1, F2 and F3 act on the detachable mechanical connection between tool holder 4 and retaining-carriage guide 10.

The inertial forces, not indicated in FIG. 4, acting on the bending tool, likewise act at the center of gravity P.

FIG. 5 comprises a table, in which the voltage [V] with which the electromagnet is energized is entered in the first column from left to right. In the fourth column, the attainable power [W] is entered that can be maintained over a duration in seconds [s], entered in column 11, in order to suppress an overheating of the electromagnet. The table contained in FIG. 5 relates to a 12-V electromagnet.

As follows from FIG. 5, a 12-V electromagnet can be energized for only 74 seconds with 24 volt and consequently with an elevated voltage for generation of an elevated magnetic force.

FIG. 6 symbolically shows a diagram, wherein the time t is plotted on the abscissa and the voltage V on the ordinate, with which voltage V the electromagnet 2 is energized. It is expressly pointed out that no magnitudes of the voltage and/or no time values can be inferred from the diagram.

A working cycle 12 takes place following an idle time 15. During the working cycle 12, the electromagnet 2 is energized at least partly with a voltage, so that a magnetic force is generated.

The method according to the invention may—as illustrated in FIG. 6—be executed such that a second time span 14 of the working cycle 12 follows a first time span 13 of the working cycle 12, wherein the electromagnet 2 is energized with a first nominal voltage in the first time span 13, whereas the electromagnet 2 is energized with a second nominal voltage in the second time span 14. In FIG. 6, for reasons of clarity, only a first time span 13 and a second time span 14 respectively of a working cycle 12 are denoted by reference numerals.

The first nominal voltage and the second nominal voltage are different. Due to the alternating nominal voltages, it results that the electromagnet 2 is energized, during a working cycle 12, for a shorter time in total with the higher first nominal voltage than during an energization with a high nominal voltage over the entire time period of the working cycle 12. Due to the inertia of the electromagnet 2, the magnetic force generated by the alternating energization with the first nominal voltage and the second nominal voltage remains substantially constant. Since the electromagnet 2 is energized with a high first voltage only over short first time periods 13, no overheating of the electromagnet takes place. The problem of the overheating of the electromagnet occurs—as is evident from the table in FIG. 5—upon an energization with voltages higher than the nominal voltage.

The invention claimed is:

1. A method for positioning a bending tool by means of an electromagnet, the method comprising the steps of:

providing the bending tool comprising a tool holder, the electromagnet and a magnet holder of a magnetizable material coupled to the electromagnet, wherein the bending tool is held on a retaining-carriage guide, displacing the bending tool, including the tool holder, the electromagnet and the magnet holder along the retaining-carriage guide via a retaining carriage, and thereby displacing the electromagnet along a magnetic guide extending along the retaining-carriage guide, energizing the electromagnet with a nominal voltage for generation of a nominal force as magnetic force, increasing or decreasing the nominal force by a pulse width modulation or by a change of a voltage or by a change of the current capacity in time spans for generation of the necessary magnetic force, depending on:

the tool weight and/or the inertial forces acting on the bending tool and/or the friction acting in the retaining-carriage guide and/or the orientation of the magnetic force relative to the movement direction and/or the size of a contact area of respective contact faces of the electromagnet and the magnet holder and/or an extension of the magnetic field into regions having further magnetizable workpieces.

2. The method according to claim 1, further comprising the step of increasing or decreasing the nominal force in levels.

3. The method according to claim 1, further comprising the steps of measuring a tool weight and/or eccentricity with measuring devices and/or retrieving the tool weight and/or eccentricity from a database, and adjusting the magnetic force in dependence on the eccentricity.

4. The method according to claim 1, further comprising the step of increasing or decreasing the nominal force in dependence on a position of the retaining carriage and/or of a passage of time.

5. The method according to claim 1, further comprising the step of partly demagnetizing the bending tool.

6. The method according to claim 1, wherein the bending tool is partly demagnetized in dependence on demagnetization parameters comprising a temporary position of the retaining carriage or of the bending tool.

7. The method according to claim 6, wherein the bending tool is demagnetized at least partly before and/or during and/or after a deposition of the bending tool.

8. The method according to claim 6, further comprising the step of adjusting the demagnetization parameters depending on a movement of the bending tool and/or of a speed of movement of the bending tool.

9. The method according to claim 6, further comprising the step of loading the demagnetization parameters from a database.

* * * * *